US011832669B2

(12) United States Patent
Lotti

(10) Patent No.: US 11,832,669 B2
(45) Date of Patent: Dec. 5, 2023

(54) LASH EXTENSIONS AND METHODS OF MANUFACTURE AND USE THEREOF

(71) Applicant: Lashify, Inc., Los Angeles, CA (US)

(72) Inventor: Sahara Lotti, Los Angeles, CA (US)

(73) Assignee: Lashify, Inc., North Hollywood, CA (US)

( * ) Notice: Subject to any disclaimer, the term of this patent is extended or adjusted under 35 U.S.C. 154(b) by 501 days.

(21) Appl. No.: 16/644,578

(22) PCT Filed: Jan. 14, 2020

(86) PCT No.: PCT/US2020/013561
§ 371 (c)(1),
(2) Date: Mar. 5, 2020

(87) PCT Pub. No.: WO2020/150273
PCT Pub. Date: Jul. 23, 2020

(65) Prior Publication Data

US 2021/0161233 A1 Jun. 3, 2021

Related U.S. Application Data

(60) Provisional application No. 62/792,048, filed on Jan. 14, 2019.

(51) Int. Cl.
*A41G 5/00* (2006.01)
*A41G 5/02* (2006.01)

(52) U.S. Cl.
CPC ..... *A41G 5/02* (2013.01); *A41G 5/0046* (2013.01); *A41G 5/0086* (2013.01)

(58) Field of Classification Search
CPC ..... A41G 5/02
See application file for complete search history.

(56) References Cited

U.S. PATENT DOCUMENTS 1,021,063 A 3/1912 Miller
1,450,259 A 4/1923 Charles
1,831,801 A 11/1931 Birk
(Continued)

FOREIGN PATENT DOCUMENTS

CN 102975141 A 3/2013
CN 103027410 A 4/2013
(Continued)

OTHER PUBLICATIONS

Delicate Hummingbird, Ha! I've mastered the false lashes!, http://delicatehummingbird.blogspot.com/2011/11/ha-ive-mastered-false-lashes.html, Nov. 10, 2011 (12 pages).
(Continued)

*Primary Examiner* — Rachel R Steitz
(74) *Attorney, Agent, or Firm* — Lowenstein Sandler LLP

(57) ABSTRACT

This disclosure discloses a lash extension comprising: a first hair having a first proximal end and a first distal end; a second hair having a second proximal end and a second distal end; and a base intersecting the first hair between the first proximal end and the first distal end and the second hair between the second proximal end and the second distal end such that a first segment of the first hair extends between the base and the first proximal end and a second segment of the second hair extends between the base and the second proximal end.

40 Claims, 2 Drawing Sheets

(56) References Cited

U.S. PATENT DOCUMENTS 1,897,747 A 2/1933 Birk
1,920,401 A 8/1933 Kahn
2,013,011 A 9/1935 Sheldon
D101,791 S 7/1936 Rauh
2,079,256 A 5/1937 Kaiser
D129,526 S 9/1941 Hanisch
2,268,082 A 12/1941 Philips
2,323,595 A 7/1943 Hanisch
2,392,694 A 1/1946 Rector
D155,559 S 2/1946 Tillmann
2,421,432 A 6/1947 Phillips
D154,227 S 5/1948 Alvizua
2,618,279 A 11/1952 Reiffert
2,812,768 A 11/1957 Giuliano
D189,888 S 3/1961 Tapper
3,016,059 A 1/1962 Hutton
3,032,042 A 5/1962 Borg
3,032,342 A 5/1962 Glass
3,174,321 A 3/1965 Williams
3,245,416 A 4/1966 Victor
3,295,534 A 1/1967 Jess
3,343,552 A 9/1967 Steffen
3,392,727 A 7/1968 Hanlon
3,447,540 A 6/1969 Osher
3,454,015 A 7/1969 Udes
3,478,754 A 11/1969 Martin, Jr.
3,547,135 A 12/1970 Roos
3,557,653 A 1/1971 Kim
3,561,454 A 2/1971 Oconnell
3,625,229 A 12/1971 Silson
3,645,281 A 2/1972 Seidler
3,670,742 A 6/1972 Weaner
3,703,180 A 11/1972 Aylott
3,828,803 A 8/1974 Windsor
3,833,007 A 9/1974 Jacobs
3,900,038 A 8/1975 Masters
D240,769 S 7/1976 Bowman
3,968,807 A 7/1976 Kraicer
3,970,092 A 7/1976 Nelson
3,970,992 A 7/1976 Boothroyd et al.
3,971,392 A 7/1976 Brehmer
3,980,092 A 9/1976 Garufi
3,982,313 A 9/1976 Nelson, Jr.
4,016,889 A 4/1977 Cowles
4,029,111 A 6/1977 Barton
4,049,006 A 9/1977 Saunders et al.
4,163,535 A 8/1979 Austin
4,168,713 A 9/1979 Agiotis
4,203,518 A 5/1980 Current
4,205,693 A 6/1980 Mallouf
4,225,693 A 9/1980 McCormick
4,254,772 A 3/1981 McNamee
4,254,784 A 3/1981 Nelson
4,284,092 A 8/1981 Auretta
4,296,765 A 10/1981 Bachtell
D261,601 S 11/1981 Kettlestrings
4,299,242 A * 11/1981 Choe ..... A41G 5/02
132/53
4,360,033 A 11/1982 Schmehling
4,395,824 A 8/1983 Puro
D270,551 S 9/1983 Thayer
4,458,701 A 7/1984 Holland
4,509,539 A 4/1985 Alfieri
D280,354 S 8/1985 Bakic
D281,259 S 11/1985 Hensley
D281,825 S 12/1985 Bakic
4,600,029 A 7/1986 Ueberschaar
4,697,856 A 10/1987 Abraham
4,739,777 A 4/1988 Nelson
4,767,492 A 8/1988 Fukusima
D298,070 S 10/1988 Ferrari
4,784,713 A 11/1988 Van Nieulande
D299,561 S 1/1989 Bakic
D301,371 S 5/1989 Kaprelian
D302,602 S 8/1989 Bakic
4,865,057 A 9/1989 Braun
4,934,387 A 6/1990 Megna
4,964,428 A 10/1990 Lamatrice
D314,066 S 1/1991 Bakic
5,010,914 A 4/1991 Merges
D318,346 S 7/1991 Bakic
5,033,626 A 7/1991 Platti
5,072,745 A 12/1991 Cheh
5,082,010 A 1/1992 Skaryd et al.
5,117,846 A 6/1992 Finamore et al.
D328,246 S 7/1992 Nottingham et al.
5,154,195 A 10/1992 Irisawa
D342,671 S 12/1993 Elliott
D343,340 S 1/1994 Frye, Jr. et al.
5,307,826 A 5/1994 Iosilevich
D348,219 S 6/1994 Goldberg
5,322,166 A 6/1994 Crowther
5,368,052 A 11/1994 Finamore
5,377,700 A 1/1995 Harris
D358,312 S 5/1995 Keenan
D358,908 S 5/1995 Rawski
5,411,775 A 5/1995 Wilson
5,419,345 A 5/1995 Kadymir
D359,583 S 6/1995 Abbo
D368,495 S 4/1996 Rypinski
5,533,529 A 7/1996 Ohno
5,547,529 A 8/1996 Woolf
D373,726 S 9/1996 Power
5,571,543 A 11/1996 Song et al.
D379,923 S 6/1997 De Baschmakoff
D380,616 S 7/1997 Leslie et al.
D382,198 S 8/1997 Mulhauser et al.
D386,808 S 11/1997 Litton
D387,483 S 12/1997 Sloan
D388,549 S 12/1997 Mouyiaris et al.
5,746,232 A 5/1998 Martin et al.
5,765,571 A 6/1998 Dinnel
D397,040 S 8/1998 Bakic
5,813,418 A 9/1998 Pillars
D403,922 S 1/1999 Terracciano et al.
D404,531 S 1/1999 Bakic et al.
5,894,846 A 4/1999 Gang
5,896,996 A 4/1999 Chuang
D411,649 S 6/1999 Bakic
D418,018 S 12/1999 Winsted
D418,253 S 12/1999 Bakic
6,003,467 A 12/1999 Shelton-Ferrell et al.
6,016,814 A 1/2000 Elliott
6,019,107 A 2/2000 Overmyer et al.
6,029,674 A 2/2000 Han
6,032,609 A 3/2000 Luoma
6,035,861 A 3/2000 Copello
6,092,291 A 7/2000 Cendoma
6,109,274 A 8/2000 Ingersoll
D437,086 S 1/2001 Dickert
6,174,321 B1 1/2001 Webb
6,182,839 B1 2/2001 Robbins et al.
D442,304 S 5/2001 Huang
6,230,715 B1 5/2001 Cho
D443,471 S 6/2001 Lillelund et al.
6,247,476 B1 6/2001 Sartena
6,257,250 B1 7/2001 Sartena
6,265,010 B1 7/2001 Franco
D448,927 S 10/2001 Vazquez
6,302,115 B1 10/2001 Sartena
6,308,716 B1 10/2001 Han
D452,151 S 12/2001 Scott
D454,981 S 3/2002 Lamagna et al.
D456,077 S 4/2002 Etter et al.
D456,097 S 4/2002 LaMagna et al.
D458,413 S 6/2002 Boilen
6,405,736 B2 6/2002 Townsend
6,439,406 B1 8/2002 Duhon
D463,280 S 9/2002 Brozell
D463,744 S 10/2002 Brozell
D464,565 S 10/2002 Weinstein et al.
D464,877 S 10/2002 Weinstein et al.
6,471,515 B2 10/2002 Feuer
D467,800 S 12/2002 Chen et al.

(56) References Cited

U.S. PATENT DOCUMENTS 6,494,212 B1 12/2002 Yamakoshi
6,530,379 B2 3/2003 Iosilevich
D472,675 S 4/2003 Lamagna
D472,810 S 4/2003 Gelardi et al.
D473,106 S 4/2003 Scherer
6,561,197 B2 5/2003 Harrison
6,567,640 B2 5/2003 Ishikawa
D475,616 S 6/2003 Lambrecht
6,581,609 B2 6/2003 Ott
D479,365 S 9/2003 Todeschini
D480,864 S 10/2003 Sayers et al.
D481,946 S 11/2003 Nicholson et al.
D481,952 S 11/2003 Orsomando
D482,495 S 11/2003 Jackel-Marken
D482,928 S 12/2003 Liu
D482,934 S 12/2003 Liu
D483,232 S 12/2003 Liu
D483,633 S 12/2003 Jansson et al.
D483,909 S 12/2003 Todeschini
D485,359 S 1/2004 McMichael et al.
6,688,315 B1 2/2004 Harrison
6,691,714 B1 2/2004 Yaguchi et al.
6,708,696 B2 3/2004 Ferguson
D488,353 S 4/2004 Govrik et al.
D488,618 S 4/2004 Wekstein
D490,932 S 6/2004 Mammone
D491,336 S 6/2004 Cecere
D495,834 S 9/2004 Todeschini
D496,759 S 9/2004 Rodriguez
6,820,625 B2 11/2004 Park
D501,580 S 2/2005 Sugawara
D506,573 S 6/2005 de Grandcourt
D507,678 S 7/2005 Lamagna
6,935,348 B2 8/2005 Gold
6,935,349 B2 8/2005 Nicot et al.
D509,942 S 9/2005 Connolly et al.
D512,913 S 12/2005 Gauthier
6,973,931 B1 12/2005 King
6,981,814 B2 1/2006 Geardino et al.
D515,242 S 2/2006 Cho
D516,247 S 2/2006 Merheje
7,000,775 B2 2/2006 Gelardi et al.
7,036,518 B2 5/2006 Park
D522,376 S 6/2006 Hales
D532,891 S 11/2006 Buthier et al.
D533,650 S 12/2006 Ohta
D534,426 S 1/2007 Bakic
7,159,720 B2 1/2007 Pearson
7,168,432 B1 1/2007 Brumfield
D537,208 S 2/2007 Shaljian
D540,112 S 4/2007 Nichols et al.
D543,662 S 5/2007 Bivona et al.
D543,815 S 6/2007 Metcalf
D543,850 S 6/2007 Legros
D544,148 S 6/2007 Bivona et al.
D544,202 S 6/2007 Markfelder
D545,396 S 6/2007 Casey et al.
7,228,863 B2 6/2007 Dumler et al.
D546,002 S 7/2007 Bowen
D547,940 S 8/2007 Sandy
D559,457 S 1/2008 Garland et al.
D561,045 S 2/2008 Lee
D561,942 S 2/2008 Khubani
7,331,351 B1 2/2008 Asai
D563,157 S 3/2008 Bouveret et al.
D563,616 S 3/2008 Lynde et al.
D563,728 S 3/2008 Welch, III
7,343,921 B2 3/2008 Salinas
D569,041 S 5/2008 Azoulay
D569,553 S 5/2008 Cho
7,374,048 B2 5/2008 Mazurek
D571,543 S 6/2008 Sungadi
D573,308 S 7/2008 Wittke-Kothe
D575,904 S 8/2008 Iqbal
D579,059 S 10/2008 Chan
7,469,701 B1 12/2008 Bernard
D584,449 S 1/2009 Shaljian
D587,529 S 3/2009 Pratt
D588,746 S 3/2009 Ross
D591,599 S 5/2009 Okin et al.
D592,923 S 5/2009 Konopka
7,533,676 B2 5/2009 Sthair
D595,054 S 6/2009 Whitaker
7,543,718 B2 6/2009 Simon
D600,441 S 9/2009 Estrada
D602,354 S 10/2009 Dibnah et al.
7,600,519 B2 10/2009 Dinh
D604,579 S 11/2009 Robinson et al.
7,610,921 B2 11/2009 Gold
D605,514 S 12/2009 Weber
D607,332 S 1/2010 Huntington et al.
D615,290 S 5/2010 Heffner
D617,187 S 6/2010 Murray
D617,943 S 6/2010 Bouix et al.
D618,078 S 6/2010 Cripps et al.
7,748,391 B2 7/2010 Vance
D627,103 S 11/2010 Cho
7,836,899 B2 11/2010 Sugai et al.
D631,606 S 1/2011 Chen
7,896,192 B2 3/2011 Conley et al.
D638,733 S 5/2011 Sullivan et al.
7,938,128 B2 5/2011 Gueret
D639,196 S 6/2011 Sullivan et al.
D640,005 S 6/2011 Lee et al.
D640,834 S 6/2011 Chen
D641,106 S 7/2011 Williams et al.
8,015,980 B2 9/2011 Rabe et al.
8,025,065 B2 9/2011 Guliker
8,042,553 B2 10/2011 Paris
D647,799 S 11/2011 Dunwoody
8,061,367 B2 11/2011 Rabe et al.
D650,669 S 12/2011 Dunwoody
D650,670 S 12/2011 Dunwoody
D651,082 S 12/2011 Dunwoody
8,113,218 B2 2/2012 Nguyen
8,127,774 B2 3/2012 Dinh
D657,496 S 4/2012 Flatt
D657,696 S 4/2012 Floyd et al.
D659,330 S 5/2012 Davis
8,171,943 B2 5/2012 Hamano
8,186,361 B2 5/2012 Hampton
D661,185 S 6/2012 Battat
D661,599 S 6/2012 Floyd et al.
8,191,556 B2 6/2012 Betts
8,196,591 B2 6/2012 Lee et al.
8,205,761 B2 6/2012 Stull, Sr. et al.
D663,113 S 7/2012 Simms
D664,011 S 7/2012 Affonso
8,225,800 B2 * 7/2012 Byrne ..... A41G 5/02 132/216
D669,223 S 10/2012 Lee et al.
D670,030 S 10/2012 Nguyen
D673,325 S 12/2012 Martines
8,342,186 B2 1/2013 Freelove
8,347,896 B2 1/2013 Liao
D679,590 S 4/2013 Stull, Sr. et al.
D679,591 S 4/2013 Stull, Sr. et al.
D679,592 S 4/2013 Stull, Sr. et al.
D679,595 S 4/2013 Stull, Sr. et al.
D679,596 S 4/2013 Stull, Sr. et al.
D682,103 S 5/2013 Jedlicka et al.
D682,688 S 5/2013 Murray
8,434,500 B2 5/2013 Alex
D686,495 S 7/2013 Murray
D690,419 S 9/2013 Porat
8,528,571 B2 9/2013 Costa
8,567,640 B1 10/2013 Johnson-Lofton
8,578,946 B2 11/2013 Ellery
8,596,284 B2 12/2013 Byrne
8,616,223 B2 12/2013 Rabe et al.
D698,078 S 1/2014 Purizhansky et al.
8,657,170 B2 2/2014 Martinez
D700,799 S 3/2014 Ludeman et al.
D702,510 S 4/2014 Segal

(56) References Cited

U.S. PATENT DOCUMENTS

| | | | |
|---|---|---|---|
| 8,701,685 | B2 | 4/2014 | Chipman |
| D707,392 | S | 6/2014 | Yu et al. |
| D707,556 | S | 6/2014 | Kawamura |
| 8,739,803 | B2 | 6/2014 | Freelove |
| 8,752,562 | B2 | 6/2014 | Dinh |
| D709,129 | S | 7/2014 | Moertl |
| D711,227 | S | 8/2014 | Sheikh |
| D713,217 | S | 9/2014 | Micara-Sartori et al. |
| D714,494 | S | 9/2014 | Vasquez et al. |
| 8,826,919 | B2 | 9/2014 | Dinh |
| D716,498 | S | 10/2014 | Wolff |
| D717,038 | S | 11/2014 | Lee |
| 8,875,718 | B2 | 11/2014 | Dinh |
| 8,881,741 | B1 | 11/2014 | Mattson et al. |
| 8,881,744 | B2 | 11/2014 | McKinstry |
| D718,901 | S | 12/2014 | Parker |
| 8,939,159 | B2 | 1/2015 | Yeo et al. |
| 8,967,158 | B2 | 3/2015 | Sanbonmatsu |
| 9,004,076 | B2 | 4/2015 | Le |
| 9,004,299 | B2 | 4/2015 | Hardin |
| 9,027,568 | B2 | 5/2015 | Lee |
| 9,044,076 | B2 | 6/2015 | Temple |
| 9,078,480 | B2 | 7/2015 | Beschta |
| 9,107,461 | B2 | 8/2015 | Martins et al. |
| D738,579 | S | 9/2015 | Owens et al. |
| D738,611 | S | 9/2015 | Gupta |
| 9,149,083 | B1 | 10/2015 | Dinh |
| 9,155,345 | B2 | 10/2015 | Nisim et al. |
| 9,179,722 | B2 | 11/2015 | Le |
| 9,185,943 | B2 | 11/2015 | Merszei |
| D746,046 | S | 12/2015 | Lee |
| D746,514 | S | 12/2015 | Lambridis et al. |
| 9,215,901 | B1 | 12/2015 | Schroeder |
| 9,254,012 | B2 | 2/2016 | Pham |
| D751,904 | S | 3/2016 | Landrum et al. |
| 9,277,777 | B2 | 3/2016 | Lee et al. |
| 9,284,111 | B2 | 3/2016 | Huang |
| D753,455 | S | 4/2016 | Hyma et al. |
| D753,881 | S | 4/2016 | Hussain et al. |
| 9,314,085 | B2 | 4/2016 | Hatch |
| D755,577 | S | 5/2016 | Segal |
| D757,274 | S | 5/2016 | Gelb et al. |
| D758,009 | S | 5/2016 | Berkos |
| 9,339,072 | B2 | 5/2016 | Kenna |
| 9,351,752 | B2 | 5/2016 | Slavin |
| D761,489 | S | 7/2016 | Krakovszki |
| D762,433 | S | 8/2016 | Yang |
| D764,688 | S | 8/2016 | Robinson et al. |
| D765,909 | S | 9/2016 | Marchica et al. |
| 9,439,465 | B2 | 9/2016 | Ott |
| 9,451,800 | B2 | 9/2016 | Dinh |
| 9,456,646 | B2 | 10/2016 | Calina |
| 9,462,837 | B2 | 10/2016 | Ngo |
| 9,468,245 | B2 | 10/2016 | Woods |
| 9,486,025 | B1 | 11/2016 | Dinh |
| 9,504,285 | B2 | 11/2016 | Lin |
| D773,915 | S | 12/2016 | Barakat et al. |
| D775,270 | S | 12/2016 | Moffat |
| 9,516,908 | B2 | 12/2016 | Miyatake et al. |
| 9,565,883 | B2 | 2/2017 | Dinh |
| 9,596,898 | B2 | 3/2017 | Seawright |
| D783,899 | S | 4/2017 | Roh |
| D783,901 | S | 4/2017 | Kim et al. |
| D784,615 | S | 4/2017 | Choi |
| 9,622,527 | B2 | 4/2017 | Nguyen |
| D788,556 | S | 6/2017 | James |
| 9,730,481 | B2 | 8/2017 | Uresti |
| D796,582 | S | 9/2017 | Beard |
| D800,966 | S | 10/2017 | Silva |
| D805,135 | S | 12/2017 | Beard |
| D806,315 | S | 12/2017 | Hardwick |
| 9,833,028 | B2 | 12/2017 | Jang et al. |
| 9,848,661 | B2 | 12/2017 | Harris et al. |
| 9,848,662 | B2 | 12/2017 | Dinh |
| D810,534 | S | 2/2018 | Liu |
| D810,543 | S | 2/2018 | Astradsson et al. |
| D811,872 | S | 3/2018 | Wu |
| D814,107 | S | 3/2018 | Lotti et al. |
| D814,260 | S | 4/2018 | Dhubb |
| 9,930,919 | B1 | 4/2018 | Branker et al. |
| D817,132 | S | 5/2018 | Yang |
| 9,993,373 | B2 | 6/2018 | Nassif et al. |
| D823,538 | S | 7/2018 | Ruggaber |
| D823,683 | S | 7/2018 | Caldwell |
| D825,333 | S | 8/2018 | Ozamiz et al. |
| D828,013 | S | 9/2018 | Van Wijngaarden et al. |
| D828,014 | S | 9/2018 | Van Wijngaarden et al. |
| D828,629 | S | 9/2018 | Hussain |
| D829,381 | S | 9/2018 | Kim |
| D830,170 | S | 10/2018 | Holmes |
| D832,701 | S | 11/2018 | Oates |
| D832,702 | S | 11/2018 | Oates |
| D835,465 | S | 12/2018 | Son et al. |
| D836,432 | S | 12/2018 | Riedel et al. |
| 10,149,528 | B2 | 12/2018 | Erickson et al. |
| D836,943 | S | 1/2019 | Klieman |
| D837,653 | S | 1/2019 | Meranus |
| D840,104 | S | 2/2019 | Hussain et al. |
| 10,264,837 | B2 | 4/2019 | Park |
| D847,631 | S | 5/2019 | Villbrandt |
| D847,632 | S | 5/2019 | Villbrandt |
| D848,795 | S | 5/2019 | Butler |
| D850,715 | S | 6/2019 | Lotti |
| D852,412 | S | 6/2019 | Grund et al. |
| 10,362,823 | B1 | 7/2019 | Hill et al. |
| D863,419 | S | 10/2019 | Oguma et al. |
| D863,679 | S | 10/2019 | Lotti |
| 10,433,607 | B2 | 10/2019 | Ahn |
| D867,664 | S | 11/2019 | Lotti |
| D867,668 | S | 11/2019 | Lotti |
| 10,479,566 | B2 | 11/2019 | Doyle et al. |
| D871,673 | S | 12/2019 | Qureshi et al. |
| 10,532,861 | B2 | 1/2020 | Kimmel et al. |
| D877,416 | S | 3/2020 | Lotti |
| 10,660,388 | B2 | 5/2020 | Lotti |
| D890,430 | S | 7/2020 | Lotti |
| 10,721,984 | B2 | 7/2020 | Lotti |
| D895,201 | S | 9/2020 | Lotti |
| D895,958 | S | 9/2020 | Guo et al. |
| 10,791,782 | B2 | 10/2020 | Nakamura |
| D909,680 | S | 2/2021 | Hussain et al. |
| D914,965 | S | 3/2021 | Lotti |
| D917,153 | S | 4/2021 | Denei et al. |
| D918,475 | S | 5/2021 | Hu |
| D920,400 | S | 5/2021 | Saito |
| D920,465 | S | 5/2021 | Bould et al. |
| D930,788 | S | 9/2021 | Roth |
| D932,101 | S | 9/2021 | Davis et al. |
| 11,219,260 | B2 | 1/2022 | Lotti |
| 11,234,472 | B2 | 2/2022 | Lotti |
| 11,253,020 | B2 | 2/2022 | Lotti |
| 11,330,855 | B2 | 5/2022 | Lotti |
| 11,330,856 | B2 | 5/2022 | Lotti |
| 2001/0023699 | A1 | 9/2001 | Matthews |
| 2001/0035192 | A1 | 11/2001 | Townsend |
| 2001/0037813 | A1 | 11/2001 | Ra |
| 2002/0056465 | A1 | 5/2002 | Shin |
| 2002/0094507 | A1 | 7/2002 | Feuer |
| 2002/0114657 | A1 | 8/2002 | Gueret |
| 2002/0198597 | A1 | 12/2002 | Godfrey |
| 2003/0005941 | A1 | 1/2003 | Iosilevich |
| 2003/0111467 | A1 | 6/2003 | Norman et al. |
| 2003/0155317 | A1 | 8/2003 | McNeeley et al. |
| 2003/0226571 | A1 | 12/2003 | Rahman |
| 2004/0011371 | A1 | 1/2004 | Harrison |
| 2004/0011372 | A1 | 1/2004 | Park |
| 2004/0079382 | A1 | 4/2004 | Profitt-Campbell |
| 2004/0168696 | A1 | 9/2004 | Cox |
| 2004/0211436 | A1 | 10/2004 | Knight |
| 2005/0061341 | A1 | 3/2005 | Choe |
| 2005/0098190 | A1 | 5/2005 | Kim |
| 2005/0098191 | A1 | 5/2005 | Frazier |
| 2005/0115581 | A1 | 6/2005 | Choi |
| 2005/0166939 | A1 | 8/2005 | Stroud |

(56) References Cited

U.S. PATENT DOCUMENTS

| | | | |
|---|---|---|---|
| 2005/0194015 | A1 | 9/2005 | Watts |
| 2005/0247326 | A1 | 11/2005 | Park |
| 2005/0252517 | A1 | 11/2005 | Salinas |
| 2005/0252518 | A1 | 11/2005 | Salinas |
| 2006/0065280 | A1 | 3/2006 | Cheung |
| 2006/0065281 | A1 | 3/2006 | Kim |
| 2006/0081267 | A1 | 4/2006 | Kuptiz |
| 2006/0096609 | A1 | 5/2006 | Nwokola |
| 2006/0124658 | A1 | 6/2006 | Coe et al. |
| 2006/0129187 | A1 | 6/2006 | Cho |
| 2006/0142693 | A1 | 6/2006 | Kahen |
| 2006/0175853 | A1 | 8/2006 | Anderson et al. |
| 2006/0180168 | A1 | 8/2006 | Dinnel |
| 2006/0180171 | A1 | 8/2006 | Kim |
| 2006/0266376 | A1 | 11/2006 | Basso |
| 2007/0023062 | A1 | 2/2007 | McKinstry et al. |
| 2007/0050207 | A1 | 3/2007 | Merszei |
| 2007/0084749 | A1 | 4/2007 | Demelo et al. |
| 2007/0157941 | A1 | 7/2007 | Awad et al. |
| 2007/0157944 | A1 | 7/2007 | Catron et al. |
| 2007/0199571 | A1 | 8/2007 | McCulloch |
| 2007/0221240 | A1 | 9/2007 | Junsuh Lee |
| 2007/0227550 | A1 | 10/2007 | Merszei |
| 2007/0272263 | A1 | 11/2007 | Gold |
| 2007/0272264 | A1 | 11/2007 | Byrne |
| 2007/0295353 | A1 | 12/2007 | Dinh |
| 2008/0017210 | A1 | 1/2008 | Eaton |
| 2008/0196732 | A1 | 8/2008 | Merszei |
| 2008/0223390 | A1 | 9/2008 | Brown |
| 2008/0276949 | A1 | 11/2008 | Lee |
| 2008/0283072 | A1 | 11/2008 | Sun |
| 2009/0014023 | A1 | 1/2009 | Waters |
| 2009/0026676 | A1 | 1/2009 | Kurita et al. |
| 2009/0028625 | A1 | 1/2009 | Bonneyrat |
| 2009/0071490 | A1 | 3/2009 | Sthair |
| 2009/0071492 | A1 | 3/2009 | Oh |
| 2009/0178689 | A1 | 7/2009 | Navarro et al. |
| 2009/0217936 | A1 | 9/2009 | Sato et al. |
| 2009/0217939 | A1 | 9/2009 | Rabe et al. |
| 2009/0223534 | A1 | 9/2009 | Green |
| 2009/0241973 | A1 | 10/2009 | Hampton |
| 2009/0241979 | A1 | 10/2009 | Navarro et al. |
| 2009/0255547 | A1 | 10/2009 | Starks et al. |
| 2009/0266373 | A1 | 10/2009 | Kupitz |
| 2009/0266376 | A1 | 10/2009 | Beschta |
| 2010/0043816 | A1 | 2/2010 | Dix |
| 2010/0065078 | A1 | 3/2010 | Reece |
| 2010/0070526 | A1 | 3/2010 | Matias |
| 2010/0127228 | A1 | 5/2010 | Xie et al. |
| 2010/0170526 | A1 | 7/2010 | Nguyen |
| 2011/0079233 | A1 | 4/2011 | Cheh |
| 2011/0079235 | A1 | 4/2011 | Reed |
| 2011/0079236 | A1 | 4/2011 | Lee |
| 2011/0121592 | A1 | 5/2011 | Cho |
| 2011/0127228 | A1 | 6/2011 | Sagel |
| 2011/0220136 | A1 | 9/2011 | Kang |
| 2011/0226274 | A1 | 9/2011 | Turner |
| 2011/0240049 | A1 | 10/2011 | Kim et al. |
| 2011/0278869 | A1 | 11/2011 | Lee et al. |
| 2011/0290271 | A1 | 12/2011 | Rabe et al. |
| 2011/0290937 | A1 | 12/2011 | Salkeld |
| 2012/0037177 | A1 | 2/2012 | Teater Makinen |
| 2012/0055499 | A1 | 3/2012 | Sanbonmatsu |
| 2012/0160259 | A1 | 6/2012 | Nguyen et al. |
| 2012/0174939 | A1 | 7/2012 | Starks et al. |
| 2012/0180804 | A1 | 7/2012 | Hochi et al. |
| 2012/0266903 | A1 | 10/2012 | Devlin |
| 2012/0305020 | A1 | 12/2012 | Byrne |
| 2012/0318290 | A1 | 12/2012 | Kim |
| 2013/0019889 | A1 | 1/2013 | Palmer-Rogers |
| 2013/0032162 | A1 | 2/2013 | Major |
| 2013/0042881 | A1 | 2/2013 | Mutchler |
| 2013/0042884 | A1 | 2/2013 | Wilkinson |
| 2013/0110032 | A1 | 5/2013 | Luzon et al. |
| 2013/0160783 | A1 | 6/2013 | Ahn et al. |
| 2013/0167855 | A1 | 7/2013 | Kupitz |
| 2013/0167858 | A1 | 7/2013 | Lee |
| 2013/0255706 | A1 | 10/2013 | Dinh |
| 2013/0276807 | A1 | 10/2013 | Teater Makinen |
| 2013/0298931 | A1 | 11/2013 | Samain et al. |
| 2013/0306089 | A1 | 11/2013 | Araujo Costa |
| 2013/0306094 | A1 | 11/2013 | West |
| 2013/0312781 | A1 | 11/2013 | Murphy |
| 2013/0312782 | A1 | 11/2013 | Kindall |
| 2013/0320025 | A1 | 12/2013 | Mazzetta et al. |
| 2013/0333714 | A1 | 12/2013 | Merszei |
| 2014/0011372 | A1 | 1/2014 | Kato et al. |
| 2014/0060559 | A1 | 3/2014 | Lin |
| 2014/0069451 | A1 | 3/2014 | Hwang |
| 2014/0083447 | A1 | 3/2014 | Rabe et al. |
| 2014/0110304 | A1 | 4/2014 | Wu et al. |
| 2014/0116456 | A1 | 5/2014 | Palmer-Rogers |
| 2014/0135914 | A1 | 5/2014 | Conant |
| 2014/0216488 | A1 | 8/2014 | Dinh |
| 2014/0332025 | A1 | 11/2014 | Kim et al. |
| 2015/0020840 | A1 | 1/2015 | Rabe et al. |
| 2015/0075549 | A1 | 3/2015 | Lee et al. |
| 2015/0114421 | A1 | 4/2015 | Pham |
| 2015/0114422 | A1 | 4/2015 | Abraham et al. |
| 2015/0114423 | A1 | 4/2015 | Sanbonmatsu |
| 2015/0128986 | A1 | 5/2015 | Stookey |
| 2015/0136162 | A1 | 5/2015 | Brouillet et al. |
| 2015/0173442 | A1 | 6/2015 | Raouf |
| 2015/0181967 | A1 | 7/2015 | Dinh |
| 2015/0201691 | A1 | 7/2015 | Palmer-Rogers |
| 2015/0201692 | A1 | 7/2015 | Hansen et al. |
| 2015/0216246 | A1 | 8/2015 | Ahn et al. |
| 2016/0016702 | A1 | 1/2016 | Siskindovich et al. |
| 2016/0037847 | A1 | 2/2016 | Tavakoli |
| 2016/0037848 | A1 | 2/2016 | Lee |
| 2016/0050996 | A1 | 2/2016 | Kwon |
| 2016/0058088 | A1 | 3/2016 | Le |
| 2016/0088889 | A1 | 3/2016 | Kettavong |
| 2016/0135531 | A1 | 5/2016 | Ezechukwu |
| 2016/0174645 | A1 | 6/2016 | Goldner |
| 2016/0192724 | A1 | 7/2016 | Scott et al. |
| 2016/0192725 | A1 | 7/2016 | Merszei |
| 2016/0206031 | A1 | 7/2016 | Stoka |
| 2016/0219959 | A1 | 8/2016 | Chipman et al. |
| 2016/0286881 | A1 | 10/2016 | Ko |
| 2016/0324241 | A2 | 11/2016 | Lee |
| 2016/0324242 | A1 | 11/2016 | Hansen et al. |
| 2016/0345648 | A1 | 12/2016 | Miniello et al. |
| 2016/0353821 | A1 | 12/2016 | Calina |
| 2017/0000204 | A1 | 1/2017 | Wibowo |
| 2017/0006947 | A1 | 1/2017 | Uresti |
| 2017/0020219 | A1 | 1/2017 | Beschta |
| 2017/0049172 | A1 | 2/2017 | Ahn |
| 2017/0049173 | A1* | 2/2017 | Dinh ..... A41G 5/02 |
| 2017/0055615 | A1 | 3/2017 | Crocilla |
| 2017/0079356 | A1 | 3/2017 | Dinh |
| 2017/0079357 | A1 | 3/2017 | Dinh |
| 2017/0079358 | A1 | 3/2017 | Dinh |
| 2017/0112214 | A1 | 4/2017 | Ahn |
| 2017/0112215 | A1 | 4/2017 | Dinh |
| 2017/0112264 | A1 | 4/2017 | Park |
| 2017/0127743 | A1 | 5/2017 | Nakamura et al. |
| 2017/0150763 | A1 | 6/2017 | Schroeder |
| 2017/0208885 | A1 | 7/2017 | Alex |
| 2017/0231309 | A1 | 8/2017 | Han |
| 2017/0258163 | A1 | 9/2017 | Uresti |
| 2017/0265550 | A1 | 9/2017 | Han et al. |
| 2017/0311667 | A1 | 11/2017 | Passariello et al. |
| 2017/0340041 | A1 | 11/2017 | Nguyen |
| 2017/0347731 | A1 | 12/2017 | Chipman et al. |
| 2017/0358245 | A1 | 12/2017 | Dana |
| 2017/0360134 | A1 | 12/2017 | Crocilla |
| 2017/0360135 | A1 | 12/2017 | Ahn |
| 2017/0360136 | A1 | 12/2017 | Ferrier et al. |
| 2018/0065779 | A1 | 3/2018 | Chiba |
| 2018/0098591 | A1 | 4/2018 | Leeflang |
| 2018/0160755 | A1 | 6/2018 | Hansen et al. |
| 2018/0235299 | A1 | 8/2018 | Stoka |
| 2018/0242671 | A1 | 8/2018 | Merszei |

(56) References Cited

U.S. PATENT DOCUMENTS

| | | | |
|---|---|---|---|
| 2018/0242672 | A1 | 8/2018 | Lotti |
| 2018/0242715 | A1 | 8/2018 | Lotti |
| 2018/0352885 | A1 | 12/2018 | Kim |
| 2018/0352886 | A1 | 12/2018 | Schroeder et al. |
| 2019/0133227 | A1 | 5/2019 | Le |
| 2019/0191851 | A1 | 6/2019 | Esposito et al. |
| 2019/0254373 | A1 | 8/2019 | Kim |
| 2019/0254374 | A1 | 8/2019 | Schroeder |
| 2020/0093211 | A1 | 3/2020 | Lee |
| 2020/0260839 | A1 | 8/2020 | Lotti |
| 2021/0030140 | A1 | 2/2021 | Chico |

FOREIGN PATENT DOCUMENTS

| | | | |
|---|---|---|---|
| CN | 203897379 | U | 10/2014 |
| CN | 104363790 | A | 2/2015 |
| EP | 1839526 | A1 | 10/2007 |
| GB | 190218723 | A | 11/1902 |
| GB | 1021063 | A | 2/1966 |
| GB | 1272616 | A | 5/1972 |
| GB | 1307107 | A | 2/1973 |
| JP | 48-6937 | | 2/1973 |
| JP | 2009040718 | A | 2/2009 |
| JP | 20090440718 | | 2/2009 |
| JP | 2011500979 | A | 1/2011 |
| JP | 2011122288 | A | 6/2011 |
| JP | 2011177395 | A | 9/2011 |
| JP | 2015105447 | A | 6/2015 |
| JP | 3201846 | U | 1/2016 |
| JP | 2016027220 | A | 2/2016 |
| JP | 2016163699 | A | 9/2016 |
| JP | 2019522125 | A | 8/2019 |
| KR | 200165452 | Y1 | 2/2000 |
| KR | 200 350 229 | Y1 | 1/2004 |
| KR | 200 394 275 | Y1 | 9/2005 |
| KR | 200395554 | Y1 | 9/2005 |
| KR | 20060010717 | A | 2/2006 |
| KR | 20090010717 | | 1/2009 |
| KR | 20090010717 | A | 1/2009 |
| KR | 101336422 | B1 | 12/2013 |
| KR | 101509029 | | 4/2015 |
| KR | 101509029 | B1 | 4/2015 |
| KR | 20150140672 | A | 12/2015 |
| KR | 20190035787 | A | 4/2019 |
| RU | 2558482 | C1 | 8/2015 |
| TW | 430199 | | 9/2011 |
| WO | 2014/163364 | A1 | 10/2014 |
| WO | 2014163364 | A1 | 10/2014 |
| WO | WO2018/022914 | | 1/2018 |
| WO | 2018022914 | A1 | 2/2018 |
| WO | 2018119034 | A1 | 6/2018 |

OTHER PUBLICATIONS

Dream Lashes Curved Volume Tweezer—3 Minute Test, https://www.youtube.com/watch?v=vwgYeE0SD7s, downloaded from the internet Feb. 13, 2019 (1 page).

Hongjun web page, https://detail.1688.com/offer/574685154983.html?spm=a2615.7691456.newlist.75.22f96dc5Msy00t, downloaded from internet Oct. 31, 2018 (16 pages).

International Search Report and Written Opinion dated Mar. 12, 2018 in related PCT/2017/067513 filed Dec. 20, 2017 (10 pages).

MAC Cosmetics, 34 Lash, http://www.bornprettystore.com/false-eyelashes-thick-natural-simulation-recyclable-curly-false-eyelash-makeup-cosmetic-tools-p-4467S.html, downloaded from internet Feb. 14, 2019 (1 page).

Cruiser Portable Speaker, NYNE, published at thegamerwithkids.com, posted by Sam Versionone on Apr. 6, 2015 © not listed, online, cite visited Jun. 20, 2018. Available from Internet. URL: https://thegamerwithkids.com/2015/04/06/nyne-cruiser-review-a-wireless-speaker-for-your-bycicle/ (Year: 2015).

European Search Report issued in EP17835287A on Feb. 11, 2020 (5 pages).

European Search Report issued in EP17884561A on Sep. 11, 2020 (7 pages).

Eyelash Tweezers—FEITA Precision Eyelash Extension Tweezers Set—Professional Straight & Curved Pointed Very Fine Tip Tweezers for Lash Extensions—Black—2Pcs, amazon.com/Eyelash-Tweezers-Precision-Extension-Professional/dp/B01I2KSUDS.

First Office Action issued in CN201780033755A on Aug. 28, 2020 (8 pages).

ow to Apply Lashing using Sephora Bull Eye Lash Applicator, Nov. 14, 2012 youtube video, https://www.youtube.com/watch?v=yYwcYzXJX4M.

https://www.ebay.com/sch/i.html?_nkw=lenvy&norover=1&mkevet=1&mkevt=1&mkrid=711-156598-701868-2&mkcid=2&keywprd=ienvy&crip=4350594779_&, lenvy, retrieved Dec. 30, 2020.

Envy https://www.ebay.com/sch/i.html?_nkw=lenvy&norover=1&mkevet=1&mkrid=711-156598-701868-2&mkcid=2&keyword=ienvy&crlp=435059434779, retrieved Dec. 30, 2020.

"KISS—I-Envy by Kiss 100% Human Pre Cut Eyelash Quattro 02 Lashes, https://www.pinterest.cl/pin/576038508568497288/?amp_client_id=CLIENT_ID(_)&mweb_unauth_id=&from_amp_pin_page=true, Retrieved Dec. 30, 2020".

"KISS—i-ENVY Premium Quattro 01 Lashes, https://www.beautyproductsusa.com/home/322-kiss-i-envy-strip-eyelash-quattro-01-kpe62.html; Retrieved Dec. 30, 2020".

"KISS—i-ENVY Premium Quattro 01 Lashes, https://www.bicoastalbeauti.com/shop/kiss-brand-lashes/kiss-i-envy-premium-quattro/; Retrieved Dec. 30, 2020".

"KISS—i-ENVY Premium Quattro 01 Lashes, https://www.biloltd.net/product-p/60351.htm; Retrieved Dec. 30, 2020".

"KISS—i-ENVY Premium Quattro 01 Lashes, https://www.cashmerecosmetics.com/product/kiss-i-envy-quattro-01-lashes/; Retrieved Dec. 30, 2020".

"KISS—i-ENVY Premium Quattro 01 Lashes, https://www.ebay.com/p/1044019861; Retrieved Dec. 30, 2020".

"KISS—i-ENVY Premium Quattro 01 Lashes, https://www.loveyelashes.com/bfont-colorgreenstrip-lashesfontb-299-ienvy-by-kiss-quattro-01-(1555,129,1,48)p.html#; Retrieved Dec. 30, 2020".

"KISS—i-ENVY Premium Quattro 01 Lashes, https://www.ussalonsupply.com/Kiss-I-Envy-Quattro-01-Lashes-_p_120305.html; Retrieved Dec. 30, 2020".

KISS—i-ENVY Premium Quattro 01 Lashes, https://www.madamemadeline.com/online_shoppe/proddetail.asp?prod=mmKPE62; Retrieved Dec. 30, 2020.

"KISS—i-ENVY Quattro 01 Lashes, pack of 3https://www.amazon.com/iEnvy-Kiss-Quattro-Lashes-Pack/dp/B06XGBTCHW; Retrieved Dec. 30, 2020".

"KISS—i-ENVY Quattro 02 Lashes, pack of 3https://www.amazon.com/iEnvy-Kiss-Quattro-Lashes-Pack/dp/B017O6J2FG; Retrieved Dec. 30, 2020".

"KISS—i-ENVY Strip Eyelashes—Pack of 2,https://www.ebay.com.au/itm/Kiss-I-Envy-Strip-Eyelashes-Pack-of-2-Choose-your-Style/183303124469; Retrieved Dec. 30, 2020".

"KISS—i-ENVY Trio Lashes Ultra Volumehttps://www.unitedbeautysupply.com/product/kiss-i-envy-trio-lashes-ultra-volume-kpec/; Retrieved Mar. 9, 2021".

"KISS—i-ENVY Trio Medium Lashes 30 Trio Lashes, 2 pk.https://www.amazon.com/Kiss-Envy-Trio-Medium-Lashes/dp/B018J0RMXU; Retrieved Mar. 9, 2021".

"KISS—i-ENVY Ultra Black Trio Medium Lashes, 2 pk.https://www.amazon.com/Kiss-Envy-Ultra-Black-Medium/dp/B00W2C4HPS?th=1; Retrieved Mar. 9, 2021".

KISS—So Wispy 01 Strip Eyelashes, https://picclick.com/i-ENVY-by-Kiss-SO-WISPY-01-Strip-Eyelashes-292311410878.html; Retrieved Dec. 30, 2020.

"Kiss Ever EZ Trio Lashes Medium Combo 30 EA 2pk,https://www.ebay.com/urw/Kiss-Ever-EZ-Trio-Lashes-Medium-Combo-30-EA-2pk/product-reviews/111 7964400?pgn=2#Retrieved on Mar. 9, 2021".

Kiss Nail Products, Inc.'s Third Supplemental Objections and Responses to Lashify, Inc.'s First Set of Interrogatories (Nos. 1-56) Investigation No. 337-TA-1226, Mar. 10, 2021.

(56) References Cited

OTHER PUBLICATIONS

Lashify Gossamer Lash Cartridge https://lashify.com/collections/shop-1/products/gossamer-eye-lozenge-c-style?variant=783670738950, downloaded from internet Jun. 15, 2018 (2 pages).
Lashify Wand, https:/iwww.instagrarn.com/p/BWgeQ8wg00S/?iqshid=zauiyw8a6v5, downloaded from internet 2019 (1 page).
Lindström, I., Suojalehto, H., Henriks-Eckerman, M.L. and Suuronen, K., 2013. Occupational asthma and rhinitis caused by cyanoacrylate-based eyelash extension glues. Occupational medicine, 63(4), pp. 294-297.
MAC Cosmetics, 34 Lash, http://www.bornpretty/store.com/false-eyelashes-thick-natural-simulation-recyclable-curly-false-eyelash-makeup-cosmetic-tools-p-44675.html, downloaded from internet Feb. 14, 2019 (1 page).
Madame Madeline got lashes? KISS i-ENVY Premium Quattro 01 Lashes (KPE62), i-ENVY Strip Lashes by KISS—Madame Madeline Lashes, retrieved Dec. 30, 2020.
"Madame Madeline Lashes, Ardell Dual Lash Applicator, https://www.madamemadeline.com/online_shoppe/proddetail.asp?prod=mm62059, downloaded frominternet Oct. 18, 2018 (3 pages)."
Made In China, New Product Eyelashes Aid Eyelashes Applicator Innovative Eyelashes Curler, 2018, https://www.made-in-china.com/productdirectory.do?word=creative+eyelashe+curler&subaction=hunt&style=b&mode=and&code=0&comProvince=nolimit&order=0&isOpenCorrection=1, downloaded from internet Feb. 13, 219(2 pages).
Notter E. The Art of the Chocolatier: From Classic Confections to Sensational Showpieces. John Wiley & Sons; Jan. 18, 2018.
Pak Lajpall, Nail Artist Tweezers PL-1, http://www.laipall.com/proddetail.prod=nail-artists-tweezers 1, downloaded from internet Feb. 13, 2019 (1 page).
Peonies and Lilies, Bourjois 2 in 1 Tweezers and Faux & Fabulous Eyelashes, Posted Oct. 24, 2012 (2 pages).
"Pinterest—How to Apply iENVY Quattro collection eyelashes,https://www.pinterest.com/pin/43347215141316080/ Retrieved Dec. 30, 2020".
Pinterest search for False Eyelases: Kiss Premium Lashes, i-ENVY by KISS Premium Lashes, Lashes, False eyelashes, eyelashes; https://www.pinterest.es/amp/pin/449515606533816815/, Retrieved Dec. 30, 2020.
Pinterest search from kissusa.com; https://www.pinterest.com.au/pin/19562579608263895/; Retrieved Dec. 30, 2020.
Satkowski, M.M., 1990. The crystallization and morphology of polyethylene and its blends.
Siegmann, A. and Harget, P.J., 1980. Melting and crystallization of poly (ethylene terephthalate) under pressure. Journal of Polymer Science: Polymer Physics Edition, 18(11), pp. 2181-2196.
This DIY Lash Extension Kit Has Ruined Mascara for Me Forever, elle.com/beauty/makeup-skin-care/a20704236/lashify-lashes-kit-review/ By Kristinaa Rodulfo, May 16, 2018.
Troughton MJ. Handbook of plastics joining: a practical guide. William Andrew; Oct. 17, 2008.
Varga J, Ehrenstein GW, Schlarb AK. Vibration welding of alpha and beta isotactic polypropylenes: Mechanical properties and structure. Express Polymer Letters. Mar. 1, 2008;2(3):5-19.
www.ubuy.com.kwen-sa/catalog/product/view/id/37236 I envy by Kiss Preminum Qutrro 02 Lash buy only ubuy Qatar, Dec. 30, 2020.
European Search report dated Oct. 21, 2022, on application No. 20 74 1513.
A True Lash Extension Look in Minutes Falscara The New Way to Lash, https://www.kissusa.com/falscara-false-eyelash-extension-look, retrieve on Feb. 5, 2021.
"Amazon, Ocamo False Eyelashes Curler Stainless Steel Extension Eye Lash Applicator Remover Tweezers Clip Makeup Tools, https://www.amazon.kin/Ocamo-Eyelashes-Stanless-Extension-Applicator/dp/B07FT5XW8C?tag=googinhydr18418-21&tag=googinkenshoo-21&ascsu . . . , downloaded from internet Oct. 10, 2018 (3 pages)."
"Amazon.com : Kiss Ever Ez Lahes 30 Count Trio Lashes in Various Lengths 57927 : Beautyhttps://www.amazon.com/Kiss-Lahes-Lashes-Various-Lengths/dp/BOOJH7SR4SRetrieved on Mar. 9, 2021".
Aug. 18, 2015 "How to apply iENVY Quattro collection eyelashes" Quatro Video—https://www.youtube.com/watch?v=kW-ovlGoCmc.
"BL Kiss Envy Quattro 01 Lashes—Two Pack, https://www.ebay.ca/itm/BL-Kiss-I-Envy-Quattro-O 1-Lashes-Two-PACK-/293706028541, Retrieved on Dec. 30, 2020".
Born Pretty, False Eyelashes Thick Natural Simulation Recyclable Curly False Eyelash Makeup Cosmetic Tools, http://www.bornprettystore.com/false-eyelashes-thick-natural-simulation-recyclable-curly-false-eyelash-makeup-cosmetic-tools-p-44675.html downloaded from internet Oct. 18, 2018 (6 pages).
Brandrup, J., Immergut, E.H., Grulke, E.A., Abe, A. and Bloch, D.R. eds., 1999. Polymer handbook (vol. 89). New York: Wiley.
Buy Korea, Plastic, False Eyelash Applicator, Multy colour, http://www.buykorea.or.kr/product-details/Plastic-False-Eyelash-Applicator-Multy-colour-3106709.html, downloaded from internet Feb. 14, 2019 (3 pages).
Buzludzha Monument, Gueorguy Stoilov circa 1980, justanotherbackpacker.com, published by blogger Rich on Apr. 29, 2014 @ 2019, online, site visited Aug. 27, 2019. Downloaded from Internet, URL: http://www.justanotherbackpacker.com/buzludzha-monument-bulgaria-ufo/ (Year: 2014).
Cosmopolitan, You've Been Applying False Eyelashes Wrong Your Whole Life, https://www.cosmopolitan.com/style-beauty/beauty/how-to/a55781/this-false-eyelash-hack-will-change-your-life/, Mar. 25, 2016 (12 pages).
Cruiser Portable Speaker, NYNE, published at thegamerwithkids.com, posted by Sam Versionone on Apr. 6, 2015 @ hot listed, online, cite visited Jun. 20, 2018. Available from Internet. URL: https://thegamerwithkids.com/2015/04/06/nyne-cruiser-review-a-wireless-speaker-for-your-bycicle/ (Year: 2015).
Delicate Hummingbird, Ha! I've mastered the false lashes!, http://delicate hummingbird.blogspot.com/2011/11/ha-ive-mastered-false-lashes.htm., Nov. 10, 2011 (12 pages).
Dream Lashes Curved Volume Tweezer—3 Minute Test, https://www.youtube.com/watch?v:cw1qYeEOSD7s, downloaded from the internet Feb. 13, 2019 (1 page).
Electron Microscopy Sciences, "EMS High Precisions and Ultra Fine Tweezers." https://www.emsdiasum.com/microscopy/products/tweezers/ultra_fine.aspx. Downloaded from the internet Feb. 13, 2019 (7 pages).
European Search Report issued in EP17835287A dated Feb. 11, 2020 (5 pages).
European Search Report issued in EP17884561A dated Sep. 11, 2020 (7 pages).
Eyelash Tweezers—FEITA Precision Eyelash Extension Tweezers Set—Professional Straight & Curved Pointed Very Fine Tip Tweezers for Lash Extensions—Black—2Pcs, amazon.com/Eyelash-Tweezers-Precision-Extension-Professional/dp/B0112KSUDS.
"Eyelashes Clip—2 Pieces False Eyelashes Applicator Tool Eyelash Extension Tweezers Remover Clip Nipperamazon.co.uk/Eyelashes-Clip-Applicator-Extension-Tweezers/dp/B07PK6VBVW".
First Office Action issued in CN201780004312A dated May 7, 2020 (17 pages).
First Office Action issued in CN201780033755A dated Aug. 28, 2020 (8 pages).
Focallure, https://shopfocallure.com/collections/eyelashes/products/eyelash-tweezer-by-focallure, downloaded from internet Feb. 14, 2019 (1 page).
Hollyren, DIY Eyelash Extensions Superfine Band Cluster Lashes Kit, retrieve Feb. 5, 2021.
Hongjun web page, https://detail.1686.com/offer/574685154963.html?spm=a2615.7691456.newlist.75.22f96dc5Msy00t, downloaded from internet Oct. 31, 2018 (16 pages).
How to Apply Lashing using Sephora Bull Eye Lash Applicator, Nov. 14, 2012 youtube video, https://www.youtube.com/watch?v=yYwcYzXJX4M.
https://picclick.com/i-ENVY-by-kiss-SO-Wispy-01-Strip-Eyelashes-292311410878.html, retrieved Dec. 30, 2020.

(56) References Cited

OTHER PUBLICATIONS https://www.bicoastalbeauti.com/shop/kiss-brand-lashes/kiss-i-envy-premium-quattro/ KISS i-ENVY Premium Quattro 01 Lashes (KPE62), retrieved Dec. 30, 2020.
https://www.ebay.com/sch/i.html?_nkw=lenvy&norover=1&mkevet=1&mkevt=1&mkrid=711-156598-701868-2&mkcid=2&keywprd=ienvy&crip=435059434779_&, lenvy, retrieved Dec. 30, 2020.
https://www.madamemadeline.com/online_shoppe/proddetail.asp?prod=mmKPE62, KISS i-ENVY Premium Quattro 01 Lashes (KPE62), retrieved Dec. 30, 2020.
i-ENVY by Kiss So Wispy #01 Strip Eyelashes KPE58 False Lashes Black 1 pair NEW, https://www.picclickimg.com/d/w1600/picV292311410878 li-ENVY-by-Kiss-SO-WISPY-01-Strip-Eyelashes.jpg) retrieved Dec. 30, 2020.
ienvy https://www.ebay.com/sch/i.html? _ nkw=Ienvy&norover=1&mkevt=1&mkrid=711-156598-701868-2&mkcid=2&keyword=ienvy&crlp=435059434779, retrieved Dec. 30, 2020.
Image Essentials, How to wear false eyelashes without looking like you're wearing them, https://imagessentials.wordpress.com/2012/03/30/how-to-wear-false-eyelashes-without-looking-like-youre-wearing-any/, Mar. 30, 2012 (5 pages).
International Search Report and Written Opinion dated Mar. 12, 2018 in related PCT/US2017/067513 filed Dec. 20, 2017 (10 pages).
International Search Report and Written Opinion dated Dec. 19, 2019 in related PCT/US2019/057104 filed Oct. 19, 2019 (8 pages).
International Search Report and Written Opinion dated Dec. 23, 2019 in related PCT/US2019/057102 filed Oct. 19, 2019 (8 pages).
International Search Report and Written Opinion dated Nov. 27, 2017 in related PCT/US2017/044217 filed Jul. 27, 2017 (10 pages).
International Search Report and Written Opinion dated Jan. 20, 2021 on application No. PCT/US20/54014.
International Search Report and Written Opinion dated May 7, 2020, on application No. PCT/US2020/013561.
Japonesque False Lash Applicator, https://japonesque.com/products/implements/false-lash-applicator/, downloaded from internet Feb. 13, 2019 (6 pages).
"Kiss—Ever Ez Lashes 30 Count Trio Lashes in Various Lengthshttps://www.amazon.com/Kiss-Lahes-Lashes-Various-Lengths/dp/B00JH7SP4S; Retrieved Mar. 9, 2021".
"Kiss—i-ENVY 100% Human Eyelash So Wispy 03;https://www.pinterest.co.kr/pin/308285536984155041/Retrieved Dec. 30, 2020".
"Kiss—I-Envy by Kiss 100% Human Pre Cut Eyelash Quattro 02 Lashes, https://www.pinterest.cl/pin/576038608568497288/?amp_client_id=CLIENT_ID( )&mweb_unauth_id=&from_amp_pin_page=true, Retrieved Dec. 30, 2020".
"Kiss—I-Envy by Kiss Premium Quattro 02 Lashes, https://www.lashaddict.nl/kiss-i-envy-lashes-quattro-02.html, Retrieved Dec. 30, 2020".
"Kiss—I-Envy by Kiss Premium Quattro 02 Lashes, https://www.ubuy.com.kw/en-sa/catalog/product/view/id/37236, Retrieved Dec. 30, 2020".
"Kiss—I-Envy by Kiss Premium Quattro 02 Lashes, https://www.walmart.com/ip/Kiss-I-Envy-Quattro-02-Lashes/187353459, Retrieved Dec. 30, 2020".
"Kiss—iENVY Collection;ienvybykiss.com; Retrieved Dec. 30, 2020".
"Kiss—I-ENVY Eye Lash Adhesive (6g Individual, Clear) Reviews; https://www.influenster.com/reviews/kiss-i-envy-eye-lash-adhesive-6g-individual-clear;Retrieved Dec. 30, 2020".
"Kiss—I-ENVY Individual Eye Lash Adhesive; https://www.modernbeauty.com/cosmetics/lashes/false-lashes/product/26961-i-envy-individual-eyelash-adhesive-retail.html;Retrieved Dec. 30, 2020".
"Kiss—i-ENVY Pre-Cut Lashes, https://www.shopbeautylicious.com/products/kiss-i-envy-pre-cut-lashes; Retrieved Dec. 30, 2020".
"Kiss—i-ENVY Premium Quattro 01 Lashes, https://www.amazon.ca/Kiss-ienvy-quattro-Makeup-Count/dp/B016SKJJKM; Retrieved Dec. 30, 2020".
"Kiss—i-ENVY Premium Quattro 01 Lashes, https://www.ammancart.com/products/kiss-i-envy-premium-quattro-01-lashes-kpe62; Retrieved Dec. 30, 2020".
Artificial Eyelashes (1949), https://www.youtube.com/watch?v=8Fv7EzDvo58, published Apr. 13, 2014.
Silmy's Eyelashes, YouTube (Dec. 2, 2011), https://www.youtube.com/watch?v=l_rg1ybHUwY.
D'Eyeko—Olga Lydia Factory Visit, YouTube (Jun. 24, 2013), https://www.youtube.com/watch?v=Q5ZLklqkEtY.
"The Process of Making Regular Eyelash Products, YouTube (Nov. 12, 2015),https://www.youtube.com/watch?v=mVATdu3dw5c".
"Qingdao Hongfutian Eyelash Co., Ltd., YouTube (Oct. 13, 2016),https://www.youtube.com/watch?v=rInKgJJm7-0".
Goodyard eyelash production process, YouTube (Nov. 2, 2016), https://www.youtube.com/watch?v=FIxGtTPNALo.
"How To Apply False Eyelashes For Beginners ♡ Two Easy Ways, YouTube (Sept. 6, 2013),https://www.youtube.com/watch?v=79oSI7fNzOE".
"In Depth Tutorial: Ardell Lashtite Glue | Apply Under My Natural Lashes!, YouTube (Feb. 24, 2015),https://www.youtube.com/watch?v=comq0clt56o".
"How False Eyelashes Are Made !! , YouTube (Nov. 29, 2015),HTTPS://WWW.YOUTUBE.COM/WATCH?V=HQSX0KTHWQG".
"♡ All About Eyelash Extensions! ♡ FAQ's & Application FAQ'S SaturdayNightsAlrite, YouTube (Feb. 24, 2013), https://www.youtube.com/watch?v=MTL70W58191".
"How to apply Cluster/Party Lashes 2, YouTube (Feb. 12, 2014),https://www.youtube.com/watch?v=faKvACCAvNU".
"Applying Falsies Underneath Lash!, YouTube (Sep. 24, 2016),https://www.youtube.com/watch?v=6VopJnVWv8s&feature=youtu.be".
"How To Apply Individual Lashes ft. Ardell Individuals | Melissa Alatorre, YouTube (Sep. 4, 2015),https://www.youtube.com/watch?v=c2iqLwjryWM".
"How To Apply Individual Lashes, YouTube (Mar. 16, 2013),https://www.youtube.com/watch?v=aLHE2SqzIO8".
"Lisa Eldridge—How To Apply Individual False Eyelashes Tutorial, YouTube (Mar. 17, 2010),https://www.youtube.com/watch?v=IKO10VdtLFU".
"How To: Apply Individual False Lashes—Lashes Love & Leather, YouTube (Jan. 28, 2016),https://www.youtube.com/watch?v=nLMz-lauMkl".
"How to Master Individual Fake Eyelashes | NewBeauty Tips & Tutorials, YouTube (Aug. 21, 2015),https://www.youtube.com/watch?v=ObltZN1NsB0&t=44s".
"Introducing Kiss EverEZ Trio Lashes., YouTube (May 10, 2013),https://www.youtube.com/watch?v=37z4VMQ7Yxc".
"Review | New Kiss iEnvy EZ Lashes Trio Lashes—Easier than Individual Lashes!, YouTube (Mar. 10, 2021),https://www.youtube.com/watch?v=BS9G6jgDgOA".
"How To Apply False Lashes Under Your Lashes | Reverse Eyelash Trick Makeup Hack, YouTube (Oct. 3, 2016), https://www.youtube.com/watch?v=BCq4xCQrQHE".
"How To Fake Eyelash Extensions: Reviewing Kiss Ever EZ Lashes, YouTube (Mar. 22, 2015),https://www.youtube.com/watch?v=AhJyTcClaMs".
"Reverse Eyelash Tutorial IrisBeilin, YouTube (Sep. 13, 2016),https://www.youtube.com/watch?v=q1Cu0p6bqHs".
"Reverse Eyelash Trick |Makeup Hack, YouTube (Sep. 18, 2016), https://www.youtube.com/watch? v=FQFF1sOQbCI".
"Crazy False Eyelash Hack for Natural/Comfortable Lashes !!! | WTF !!!!! , YouTube (Feb. 2, 2017), https://www.youtube.com/watch?v=99rHNYe3GFw".
"Reverse Eyelash Hack | Does it work?, YouTube (Oct. 12, 2016),https://www.youtube.com/watch?v=sx_X89xdBbE".
"Applying Falsies Under Lash ?? Does it work ??!! , YouTube (Sep. 27, 2016),https://www.youtube.com/watch? v=5kytWJOQbg".
"Applying Falsies Underneath / Reverse Best Lash Hack, YouTube (Sep. 22, 2016),https://www.youtube.com/watch?v=GhG5hoMh000".
"How To Apply False Lashes . . . Underneath !? , YouTube (Jan. 13, 2017),https://www.youtube.com/watch?v=mlkvFgb8PmA".
"Applying Falsies Underneath Lash!, YouTube (Sep. 24, 2016),https://www.youtube.com/watch?v=6VopJnVWv8s&t=13s".

(56) References Cited

OTHER PUBLICATIONS

"False Lashes Tips And Tricks For Beginners! | The how to guide for Lashes, YouTube (Jan. 27, 2017),https://www.youtube.com/watch?v=BaQO8g4iUxY".
"Applying Falsies Under Lash?! Does It Work?, YouTube (Sep. 14, 2016),https://www.youtube.com/watch?v=V96EKKAe03c".
"How to apply individual lashes, YouTube (Apr. 5, 2010),https://www.youtube.com/watch?v=9X84CUIWqgo".
"Lux Beauty Lashes—Process of making false eyelash product, YouTube (Dec. 12, 2015),https://www.youtube.com/watch?v=515QCxnjrkQ".
"The Best Way to Apply False Lashes | Cosmopolitan, YouTube (Apr. 1, 2016),https://www.youtube.com/watch?v=40yZu-4KZs8".
"Applying False Lashes Underneath Your Own Top Eye Lashes | Best Beauty Tip/Hack Ever!, YouTube (Jul. 2, 2016), https://www.youtube.com/watch?v=FzEtZgY-5Y8".
"Your guide to Russian Volume Lash Extensions, https://www.bllashes.com/blogs/blog/your-guide-to-the-must-have-tools-for-russian-volume-lashesretrieved Mar. 29, 2023".
"Process of Making Mellow Eyelashes, YouTube (Nov. 13, 2015),https://www.youtube.com/watch?v=-VlhGQX58HM&t=2s".
"How To Apply False Eyelashes For Beginners ♡ Two Easy Ways, YouTube (Sep. 6, 2013),https://www.youtube.com/watch?app=desktop&v=79oSI7fNzOE".
"How to apply iENVY Quattro collection eyelashes, Youtube (Aug. 18, 2015),https://www.youtube.com/watch?/=kWovIGoCmc".
"Learn How to Apply Trio Lashes!, Youtube (Feb. 20, 2015),https://www.youtube.com/watch?v=bx6PXgZMvhg".
"Why 'tightlining' is the makeup trick you need to try (May 6, 2016),https://www.getthegloss.com/beauty/makeup/why-tightlining-is-the-makeuptrick-you-need-to-try".
"The Small Things, How to fake a thicker lash line, May 17, 2017 https://www.thesmallthingsblog.com/2016/05/how-to-fake-a-thicker-lash-line/#:~:text=Pick%20up%20a%20gel%20or,of%20a%20thicker%20lash%20line.".
Rosato, Marlene G., and Dominick V. Rosato. Concise encyclopedia of plastics. pp. 39-52, Springer Science & Business Media, 2012.
Palin, George Richard. Plastics for Engineers: An Introductory Course. Elsevier, 1967. pp. 125-139.
Ebnesajjad S, Landrock AH. Adhesives technology handbook. William Andrew; Nov. 26, 2014. pp. 67-83.

* cited by examiner

LASH EXTENSIONS AND METHODS OF MANUFACTURE AND USE THEREOF

CROSS-REFERENCE TO RELATED PATENT APPLICATIONS

This patent application claims a benefit of U.S. Provisional Patent Application 62/792,048 filed 14 Jan. 2019, which is herein incorporated by reference in its entirety for all purposes.

TECHNICAL FIELD

This disclosure relates to lash extensions.

BACKGROUND

A lash extension or artificial eyelashes typically has a base and a plurality of hairs extending from the base. As such, when applying the lash extension to a natural eyelash of a user, the user attempts to blend the base with the natural eyelash as much as possible in order to cause the lash extension to appear as real as possible. In some lash extension styles, the base is attached to an eyelid of a user. And, depending on the thickness of the base, the base is readily observed when worn by the user, which effectively ruins the natural eyelash appearance of the lash extension.

SUMMARY

Generally, this disclosure discloses a lash extension that allows for a more natural blending with a natural eyelash of a user. The lash extension may be formed of multiple hairs that have a base between a first end of the hairs and a second end of the hairs. The base may define a first segment of hair between the first end and the base and a second segment of hair between the base and second end. In an embodiment, the base may be located towards the first end such that the hairs that extend from the base to the second end extend along natural lashes of a user. The hairs between the first end and the base may thereby be blended in with natural eyelashes of the user towards the eyelids of the user, which results in the base being better concealed as the lash extension blends with the natural lashes both above and below the base. In an embodiment, the base may be heat fused so that the base is thin. Alternatively, the base may be formed using other techniques. If the base is not heat fused, then a string, fiber, tape, or other base material may be used. By having the artificial hairs above and below the base with any style of base, the lash extensions may appear more natural when applied to natural eyelashes of a user.

In an embodiment, a lash extension may include a first hair having a first proximal end and a first distal end. A second hair may have a second proximal end and a second distal end. A base may intersect (i) the first hair between the first proximal end and the first distal end and (ii) the second hair between the second proximal end and the second distal end such that a first segment of the first hair extends between the base and the first proximal end and a second segment of the second hair extends between the base and the second proximal end. The base may be a heat fusion of the first and second hairs. Alternatively, the base may be any other connection type between the first and second hairs, including, but not limited to, tape, adhesive, string, fiber, or otherwise.

In an embodiment, a process for forming a lash extension may include depositing a first hair across a region. The first hair includes a first proximal end and a first distal end. The region intersects the first hair between the first proximal end and the first distal end such that a first segment of the first hair is formed between the region and the first proximal end. The process may include depositing a second hair across the region. The second hair includes a second proximal end and a second distal end. The region intersects the second hair between the second proximal end and the second distal end such that a second segment of the second hair is formed between the region and the second proximal end. The process may include forming a base at the region to cause the first hair and the second hair to be secured to the base.

In an embodiment, a process for forming a lash extension may include depositing a first hair having a first proximal end and a first distal end across a base such that the base intersects the first hair between the first proximal end and the first distal end thereby forming a first segment of the first hair between the base and the first proximal end. The process may include depositing a second hair having a second proximal end and a second distal end across the base such that the base intersects the second hair between the second proximal end and the second distal end thereby forming a second segment of the second hair between the base and the second proximal end. The process may include causing the first hair to be secured to the base between the first proximal end and the first distal end and the second hair to be secured to the base between the second proximal end and the second distal end.

In an embodiment, a process for forming a lash extension may include depositing a base across a first hair having a first proximal end and a first distal end such that the base intersects the first hair between the first proximal end and the first distal end and such that a first segment of hair is formed between the base and the first proximal end. The process may include depositing the base across a second hair having a second proximal end and a second distal end such that the base intersects the second hair between the second proximal end and the second distal end and such that a second segment of hair is formed between the base and the second proximal end. The process may include causing the base to be secured to the first hair between the first proximal end and the first distal end and to the second hair between the second proximal end and the second distal end.

DETAILED DESCRIPTION

Figure 1:
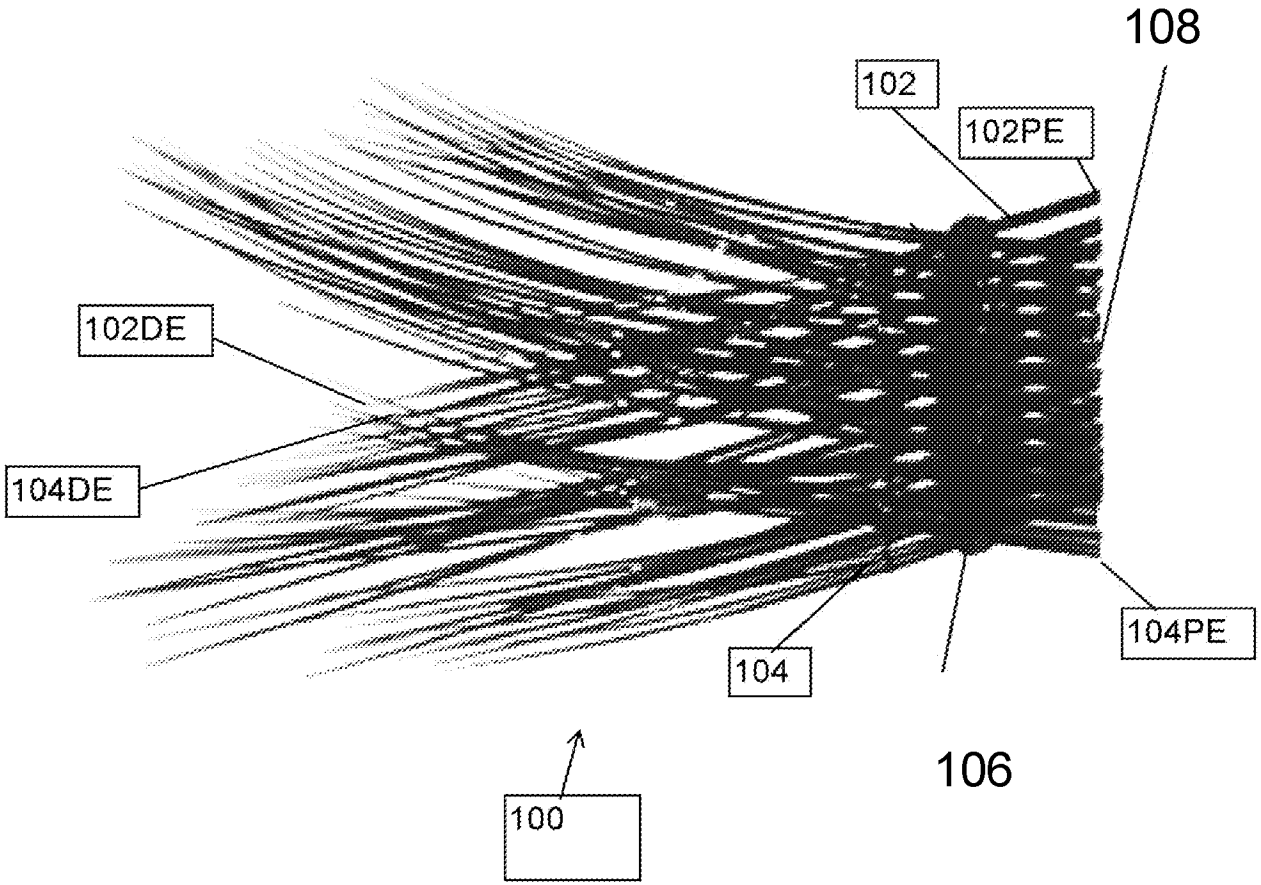
FIG. 1 shows an embodiment of a lash extension for mounting onto a natural eyelash of a user according to this disclosure.

Generally, this disclosure discloses a lash extension that allows for a more natural blending with a natural eyelash of a user. The lash extension may be formed of multiple hairs that have a base between a first end of the hairs and a second end of the hairs. The base may define a first segment of hair between the first end and the base and a second segment of hair between the base and second end. In an embodiment, the base may be located towards the first end such that the hairs that extend from the base to the second end extend along natural lashes of a user. The hairs between the first end and the base may thereby be blended in with natural eyelashes of the user towards the eyelids of the user, which results in the base being better concealed as the lash extension blends with the natural lashes both above and below the base. In an embodiment, the base may be heat fused so that the base is thin. Alternatively, the base may be formed using other techniques. If the base is not heat fused, then a string, fiber, tape, or other base material may be used. By having the artificial hairs above and below the base with any style of base, the lash extensions may appear more natural when applied to natural eyelashes of a user. Note that this disclosure may be embodied in many different forms and should not be construed as necessarily being limited to various embodiments disclosed herein. Rather, these embodiments are provided so that this disclosure is thorough and complete, and fully conveys various concepts of this disclosure to skilled artisans.

Various terminology used herein can imply direct or indirect, full or partial, temporary or permanent, action or inaction. For example, when an element is referred to as being "on," "connected," or "coupled" to another element, then the element can be directly on, connected, or coupled to another element or intervening elements can be present, including indirect or direct variants. In contrast, when an element is referred to as being "directly connected" or "directly coupled" to another element, then there are no intervening elements present.

As used herein, various singular forms "a," "an" and "the" are intended to include various plural forms as well, unless specific context clearly indicates otherwise.

As used herein, various presence verbs "comprises," "includes" or "comprising," "including" when used in this specification, specify a presence of stated features, integers, steps, operations, elements, or components, but do not preclude the presence or addition of one or more other features, integers, steps, operations, elements, components, or groups thereof.

As used herein, a term "or" is intended to mean an inclusive "or" rather than an exclusive "or." That is, unless specified otherwise, or clear from context, "X employs A or B" is intended to mean any of a set of natural inclusive permutations. That is, if X employs A; X employs B; or X employs both A and B, then "X employs A or B" is satisfied under any of the foregoing instances.

As used herein, a term "or others," "combination", "combinatory," or "combinations thereof" refers to all permutations and combinations of listed items preceding that term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AB, BBC, AAABCCCC, CBBAAA, CABABB, and so forth. Skilled artisans understand that typically there is no limit on number of items or terms in any combination, unless otherwise apparent from the context.

As used herein, unless otherwise defined, all terms (including technical and scientific terms) used herein have the same meaning as commonly understood by one of ordinary skill in an art to which this disclosure belongs. Various terms, such as those de-fined in commonly used dictionaries, should be interpreted as having a meaning that is consistent with a meaning in a context of a relevant art and should not be interpreted in an idealized or overly formal sense unless expressly so defined herein.

As used herein, relative terms such as "below," "lower," "above," and "upper" can be used herein to describe one element's relationship to another element as illustrated in the set of accompanying illustrative drawings. Such relative terms are intended to encompass different orientations of illustrated technologies in addition to an orientation depicted in the set of accompanying illustrative drawings. For example, if a device in the set of accompanying illustrative drawings were turned over, then various elements described as being on a "lower" side of other elements would then be oriented on "up-per" sides of other elements. Similarly, if a device in one of illustrative figures were turned over, then various elements described as "below" or "beneath" other elements would then be oriented "above" other elements. Therefore, various example terms "be-low" and "lower" can encompass both an orientation of above and below.

As used herein, a term "about" or "substantially" refers to a +/−10% variation from a nominal value/term. Such variation is always included in any given value/term provided herein, whether or not such variation is specifically referred thereto.

Features described with respect to certain embodiments may be combined in or with various some embodiments in any permutational or combinatory manner. Different aspects or elements of example embodiments, as disclosed herein, may be combined in a similar manner.

Although various terms first, second, third, and so forth can be used herein to describe various elements, components, regions, layers, or sections, these elements, components, regions, layers, or sections should not necessarily be limited by such terms. These terms are used to distinguish one element, component, region, layer or section from another element, component, region, layer or section. Thus, a first element, component, region, layer, or section discussed below could be termed a second element, component, region, layer, or section without departing from various teachings of this disclosure.

Features described with respect to certain example embodiments can be combined and sub-combined in or with various other example embodiments. Also, different aspects or elements of example embodiments, as disclosed herein, can be combined and sub-combined in a similar manner as well. Further, some example embodiments, whether individually or collectively, can be components of a larger system, wherein other procedures can take precedence over or otherwise modify their application. Additionally, a number of steps can be required before, after, or concurrently with example embodiments, as disclosed herein. Note that any or all methods or processes, at least as dis-closed herein, can be at least partially performed via at least one entity in any manner.

Example embodiments of this disclosure are described herein with reference to illustrations of idealized embodiments (and intermediate structures) of this disclosure. As such, variations from various illustrated shapes as a result, for example, of manufacturing techniques or tolerances, are to be expected. Thus, various example embodiments of this disclosure should not be construed as necessarily limited to various particular shapes of regions illustrated herein, but are to include deviations in shapes that result, for example, from manufacturing.

Any or all elements, as disclosed herein, can be formed from a same, structurally continuous piece, such as being unitary, or be separately manufactured or connected, such as being an assembly or modules. Any or all elements, as disclosed herein, can be manufactured via any manufacturing processes, whether additive manufacturing, subtractive manufacturing, or other any other types of manufacturing. For example, some manufacturing processes include three dimensional (3D) printing, laser cutting, computer numerical control routing, milling, pressing, stamping, vacuum forming, hydroforming, injection molding, lithography, and so forth.

FIG. 1 shows an embodiment of a lash extension for mounting onto a natural eyelash of a user according to this disclosure. In particular, a lash extension 100 includes a first hair 102 having a first proximal end 102PE and a first distal end 102DE. The lash extension 100 includes a second hair 104 having a second proximal end 104PE and a second distal end 104DE. The lash extension 100 includes a base 106 intersecting the first hair 102 between the first proximal end 102PE and the first distal end 102DE and the second hair 104 between the second proximal end 104PE and the second distal end 104DE such that a first segment 108 of the first hair 102 extends between the base 106 and the first proximal end 102PE and a second segment 108 of the second hair 104 extends between the base 106 and the second proximal end 104PE. The first hair 102 and the second hair 104 intersect each other at the base 106. The first hair 102 and the second hair 104 are spaced apart from each other along the base 106. The first hair 102 is included in a first cluster of hair and the second hair 104 is included in a second cluster of hair, where the first cluster of hair and the second cluster of hair are spaced apart from each other along the base 106.

Each of the first hair 102 and the second hair 104 can include a synthetic hair. Each of the first hair 102 and the second hair 104 can include polybutylene terephthalate (PBT). The base 106 can have a thickness between about 0.05 millimeters and about 0.15 millimeters. The base 106 can includes a string connected to the first hair 102 and the second hair 104. The first hair 102 and the second hair 104 can be monolithic with the base 106. The first hair 102 and the second hair 104 can be heat fused with the base 106. The first hair 102 and the second hair 104 are not monolithic with the base. For example, the first hair 102 or the second hair 104 can be looped or tied to the base 106. The first segment 108 and the second segment 108 can be or can avoid being identical in length. Each of the first segment 108 and the second segment 108 can have a length between about 0.2 millimeters to about 2.5 millimeters.

The lash extension 100 can be formed in several ways. For example, the base 106 can be heated. The first 102 can be deposited across the base 106, where the base 106 intersects the first hair 102 between the first proximal end 102PE and the first distal end 102DE such that the first segment 108 of the first hair 102 is formed between the base 106 and the first proximal end 102PE. The second hair 104 can be deposited across the base 106, where the base 106 intersects the second hair 104 between the second proximal end 104 PE and the second distal end 104 DE such that the second segment 108 of the second hair 104 is formed between the base 106 and the second proximal end 104PE. Heating the base 106 can include melting the base 106 such that the first hair 102 and the second hair 104 are heat fused with the base 106. Depositing the first hair 102 and depositing the second hair 104 respectively causes each of the first segment 108 of the first hair 102 and the second segment 108 of the second hair 104 to have a length between about 0.2 millimeters to about 2.5 millimeters. The first hair 102 can be cut between the base 106 and the first proximal end 102PE such that the first segment 108 of the first hair 102 still exists after being cut. The second hair 104 can be cut between the base 106 and the second proximal end 104PE such that the second segment 108 of the second hair 104 still exists after being cut. Cutting the first hair 102 can include cutting the first hair 102 between the base 106 and the first proximal end 102PE such that the first segment 108 of the first hair 102 still has a first length between about 0.2 millimeters to about 2.5 millimeters after being cut. Cutting the second hair 104 includes cutting the second hair 104 between the base 106 and the second proximal end 104PE such that the second segment 108 of the second hair 104 still has a second length between about 0.2 millimeters to about 2.5 millimeters after being cut. The first hair 102 and the second hair 104 can intersect each other at the base 106. Each of the first hair 102 and the second hair 104 can includes polybutylene terephthalate (PBT) or another suitable synthetic material.

As shown in FIG. 1, the lash extension 100 includes the spine or base 106. The spine or base 106 can include a fiber or a bundle of fibers (e.g., natural materials, natural silk, natural mink hair, synthetic materials, acrylic resin, polybutylene terephthalate (PBT), synthetic mink hair, synthetic silk, polyester, polymer). During manufacturing, the spine or base 106 can be melted or heated to predetermined pre-melt temperature and then a fiber or a bundle of fibers, which can be the first hair 102 and the second hair 104, can be positioned or deposited thereon such that the fiber or the bundle of fibers is coupled thereto (e.g., adhering, bonding). Such positioning or deposition can result in an additional length of the fiber or the bundle of fibers extending past the spine or base 106 (e.g., between about 0.2 millimeters to about 2.5 millimeters). For example, a manufacturing process can have an "open" length of the fiber or the bundle of fibers coupled to the spine or base 106, where the "open" length is longer than between about 0.2 millimeters to about 2.5 millimeters, and then that length is cut down to be sized to the above range. Further, the fiber or the bundle of fibers can be cross-crossed with another fiber or bundle of fibers where the spine or 106 base melting or heating is being performed.

Figure 2A:
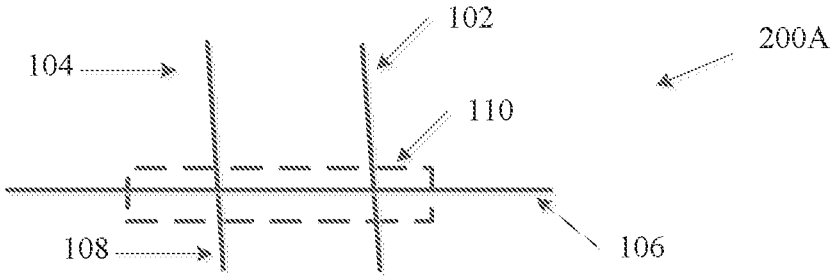
FIGS. 2A-2B show a plurality of embodiments of a plurality of lash extensions for mounting onto a natural eyelash of a user according to this disclosure.
Figure 2B:
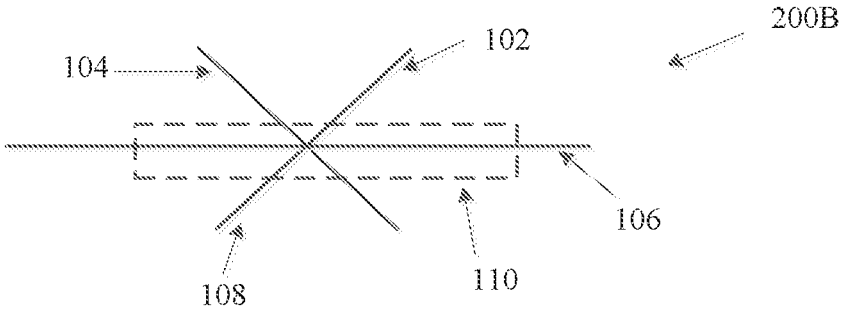

FIGS. 2A-2B show a plurality of embodiments of a plurality of lash extensions for mounting onto a natural eyelash of a user according to this disclosure. In particular, an arrangement 200A and an arrangement 200B are shown. The arrangement 200A shows the first hair 102, the second hair 104, the base 106, the first segment 108, the second segment 108, and a region 110, which can have any shape (e.g., polygonal, rectangular, oval, circular, triangular, trapezoidal, open-shaped, closed-shape, symmetrical, asymmetrical). The first hair 102 and the second hair 104 are parallel to each other within the region 110, while intersecting the base 106 within the region 110. The first segment 108 and the second segment 108 extend within the region 110 and can extend past or outside of the region. The arrangement 200B is similar to the arrangement but for the first hair 102 and the second hair 104 intersecting each other at the base 106 within the region 110.

Based on above, a process for forming a lash extension can include depositing the first hair 102 across the region 110, where the first hair includes the first proximal end 102PE and the first distal end 102DE. The region 110 intersects the first hair 102 between the first proximal end 102PE and the first distal end 102DE such that the first segment 108 of the first hair 102 is formed between the region 110 and the first proximal end 102PE. The process can include depositing the second hair 104 across the region 110, where the second hair 104 includes the second proximal end 104PE and the second distal end 104DE. The region 110 intersects the second hair 104 between the second proximal end 104PE and the second distal end 104DE such that the second segment 108 of the second hair is formed between the region 110 and the second proximal end 104PE. The process can include forming the base 106 at the region 110 to cause the first hair 102 and the second hair 104 to be secured to the base 106. For example, the process can include heating the first hair and the second hair at the region to melt the first hair and the second hair to form the base such that the first hair and the second hair are heat fused with the base. For example, the process can include depositing the first hair and depositing the second hair to respectively cause each of the first segment and the second segment to have a length between about 0.2 millimeters to about 2.5 millimeters. For example, the process can include cutting the first segment 108 at a first point between the base 106 and the first proximal end 102PE such that the first segment 108 still extends from the base 106 to the first point after the first segment 106 is cut at the first point and cutting the second segment 104 at a second point between the base 106 and the second proximal end 104PE such that the second segment 108 still extends from the base 106 to the second point after the second segment 108 is cut at the second point. For example, the process can include cutting the first segment causes the first segment to have a first length from the base to the first point, where the first length is between about 0.2 millimeters to about 2.5 millimeters. For example, the process can include cutting the second segment causes the second segment to have a second length from the base to the second point, where the second length is between about 0.2 millimeters to about 2.5 millimeters. For example, the process can include causing the first hair 102 and the second hair 104 to intersect each other at the base 106. For example, the process can include each of the first hair and the second hair includes polybutylene terephthalate (PBT) or another suitable material. For example, the process can include the base 106 may be formed of or include PBT. For example, the process can include other fibers that are melted onto the first hair 102 or the second hair 104, if not already there yet. Note that these processes can be reversed. For example, in some embodiments, the first hair 102 and the second hair 104 are deposited and then the base 106 is formed over the first hair 102 and the second hair 104, as described herein. However, in some embodiments, the base 106 is formed and then the first hair 102 and the second hair 104 are deposited over the base 106, as described herein. Note that this process, or any specific steps thereof, can be combined and/or mixed-and-matched with any other processes described herein.

Based on above, a process for forming a lash extension can include depositing the first hair 102 having the first proximal end 102PE and the first distal end 102DE across the base 106 such that the base 106 intersects the first hair 102 between the first proximal end 102PE and the first distal end 102DE thereby forming the first segment 108 of the first hair 102 between the base 106 and the first proximal end 102PE. The process may include depositing the second hair 104 having the second proximal end 104PE and the second distal end 104DE across the base 106 such that the base 106 intersects the second hair 104 between the second proximal end 104PE and the second distal end 104DE thereby forming the second segment 108 of the second hair 104 between the base 106 and the second proximal end 104PE. The process may include causing the first hair 104 to be secured to the base 106 between the first proximal end 102PE and the first distal end 102DE and the second hair 104 to be secured to the base 106 between the second proximal end 104PE and the second distal end 104DE. For example, depositing the first hair 102 and depositing the second hair 104 can be such that the first hair 102 and the second hair 104 intersect each other at the base 106. For example, the first hair 102 and the second hair 104 can be spaced apart from each other along the base 106. For example, the first hair 102 can be included in a first cluster of hair and the second hair 104 can be included in a second cluster of hair. For example, the first cluster of hair and the second cluster of hair can be spaced apart from each other along the base 106. For example, each of the first hair 102 and the second hair 104 can be a synthetic hair. For example, each of the first hair 102 and the second hair 104 can include polybutylene terephthalate (PBT). For example, the base 106 can have a thickness between about 0.05 millimeters and about 0.15 millimeters. For example, the base 106 can include a string connected to the first hair 102 and the second hair 104. For example, the first hair 102 and the second hair 104 can be monolithic with the base 106. For example, the first hair 102 and the second hair 104 can be heat fused with the base 106. For example, the first hair 102 and the second hair 104 can be not monolithic with the base 106. For example, the first segment 108 and the second segment 108 can be identical in length or not identical in length. For example, each of the first segment 108 and the second segment 108 can have a length between about 0.2 millimeters to about 2.5 millimeters. Note that this process, or any specific steps thereof, can be combined and/or mixed-and-matched with any other processes described herein.

Based on above, a process for forming a lash extension may include depositing the base 106 across the first hair 102 having the first proximal end 102PE and the first distal end 102DE such that the base 106 intersects the first hair 102 between the first proximal end 102PE and the first distal end 102DE and such that the first segment of hair 108 is formed between the base 106 and the first proximal end 102PE. The process may include depositing the base 106 across the second hair 104 having the second proximal end 104PE and the second distal end 104DE such that the base 106 intersects the second hair 104 between the second proximal end 104PE and the second distal end 104DE and such that the second segment of hair 108 is formed between the base 106 and the second proximal end 104PE. The process may include causing the base 106 to be secured to the first hair 102 between the first proximal end 102PE and the first distal end 102DE and to the second hair 104 between the second proximal end 104PE and the second distal end 104DE. For example, depositing the base 106 across the first hair 102 and depositing the base 106 across the second hair 104 can be such that the first hair 102 and the second hair 104 intersect each other at the base 106. For example, the first hair 102 and the second hair 104 can be spaced apart from each other along the base 106. For example, the first hair 102 can be included in a first cluster of hair and the second hair 104 can be included in a second cluster of hair. For example, the first cluster of hair and the second cluster of hair can be spaced apart from each other along the base 106. For example, each of the first hair 102 and the second hair 104 can be a synthetic hair. For example, each of the first hair 102 and the second hair 104 can include polybutylene terephthalate (PBT). For example, the base 106 can have a thickness between about 0.05 millimeters and about 0.15 millimeters. For example, the base 106 can include a string connected to the first hair 102 and the second hair 104. For example, the first hair 102 and the second hair 104 can be monolithic with the base 106. For example, the first hair 102 and the second hair 104 can be heat fused with the base 106. For example, the first hair 102 and the second hair 104 can be not monolithic with the base. For example, the first segment 108 and the second segment 108 can be identical in length or not identical in length. For example, each of the first segment 108 and the second segment 108 can have a length between about 0.2 millimeters to about 2.5 millimeters. Note that this process, or any specific steps thereof, can be combined and/or mixed-and-matched with any other processes described herein.

Various corresponding structures, materials, acts, and equivalents of all means or step plus function elements in various claims below are intended to include any structure, material, or act for performing the function in combination with other claimed elements as specifically claimed. Various embodiments were chosen and described in order to best disclose various principles of this disclosure and various practical applications thereof, and to enable others of ordinary skill in a pertinent art to understand this disclosure for various embodiments with various modifications as are suited to a particular use contemplated.

This detailed description has been presented for various purposes of illustration and description, but is not intended to be fully exhaustive or limited to this disclosure in various forms disclosed. Many modifications and variations in techniques and structures will be apparent to those of ordinary skill in an art without departing from a scope and spirit of this disclosure as set forth in various claims that follow. Accordingly, such modifications and variations are contemplated as being a part of this disclosure. Scope of this disclosure is defined by various claims, which include known equivalents and unforeseeable equivalents at a time of filing of this disclosure.

What is claimed is:

1. An artificial lash extension system comprising:

a plurality of lash extensions, each of the plurality of lash extensions comprising:

a plurality of clusters of artificial hairs, each of the plurality of clusters comprising multiple artificial hairs having distal ends opposite proximal ends, wherein two or more artificial hairs of a first cluster of the plurality of clusters cross two or more artificial hairs of a second cluster of the plurality of clusters; and a base, wherein the plurality of clusters are connected to the base between the distal ends and the proximal ends on the multiple artificial hairs at a region where the two or more artificial hairs of the first cluster cross the two or more artificial hairs of the second cluster.

2. The artificial lash extension system of claim 1, and wherein the region where the two or more artificial hairs of the first cluster cross the two or more artificial hairs of the second cluster is located between the proximal ends and the distal ends of the two or more artificial hairs of both the first cluster and the second cluster.

3. The artificial lash extension system of claim 2, wherein the proximal ends of each of the multiple artificial hairs of the plurality of clusters are unconnected to the base.

4. The artificial lash extension system of claim 1, wherein the multiple artificial hairs comprise a synthetic material.

5. The artificial lash extension system of claim 4, wherein the multiple artificial hairs comprise at least one of polybutylene terephthalate (PBT) or polyester.

6. The artificial lash extension system of claim 1, wherein the multiple artificial hairs comprise a natural material.

7. The artificial lash extension of claim 6, wherein the multiple artificial hairs comprise one of silk, human hair, or animal hair.

8. The artificial lash extension system of claim 1, wherein the base has a thickness between about 0.05 millimeters and about 0.15 millimeters.

9. The artificial lash extension system of claim 1, wherein the plurality of lash extensions are designed to attach to natural lashes.

10. The artificial lash extension system of claim 9, wherein the plurality of lash extension are designed to attach in an arrangement adjacent to one another at the natural lashes.

11. The artificial lash extension system of claim 9, wherein the plurality of lash extensions are designed to attach to an underside of the natural lashes.

12. The artificial lash extension system of claim 1, wherein the plurality of clusters are connected to the base by at least an application of heat.

13. The artificial lash extension system of claim 12, wherein the application of heat facilitates at least a partial melting of one or more of the plurality of clusters.

14. The artificial lash extension system of claim 12, wherein the application of heat comprises heat sealing.

15. The artificial lash extension system of claim 12, wherein the application of heat comprises heat fusing.

16. The artificial lash extension system of claim 12, wherein the application of heat facilitates at least a partial melting of at least some of the artificial hairs at the region where the two or more artificial hairs of the first cluster cross the two or more artificial hairs of the second cluster.

17. The artificial lash extension system of claim 1, wherein the plurality of clusters are connected to the base by at least an application of an adhesive.

18. The artificial lash extension system of claim 1, wherein the plurality of clusters are connected to the base by at least an application of a string.

19. The artificial lash extension system of claim 1, wherein the plurality of clusters are connected to the base by at least an application of one or more fibers.

20. The artificial lash extension system of claim 1, wherein the first cluster is directly adjacent to the second cluster.

21. A method of manufacturing a plurality of lash extensions, the method comprising, for each of the plurality of lash extensions:

depositing a plurality of clusters of artificial hairs, each of the plurality of clusters comprising multiple artificial hairs having distal ends opposite proximal ends, wherein two or more artificial hairs of a first cluster of the plurality of clusters cross two or more artificial hairs of a second cluster of the plurality of clusters; and performing a securing process to connect the plurality of clusters to a base, wherein the plurality of clusters are connected to the base between the distal ends and the proximal ends of the multiple artificial hairs at a region where the two or more artificial hairs of the first cluster cross the two or more artificial hairs of the second cluster.

22. The method of claim 21, wherein depositing the plurality of clusters of artificial hairs comprises:

arranging the plurality of clusters such that the two or more artificial hairs of the first cluster cross the two or more artificial hairs of the second cluster.

23. The method of claim 21, wherein performing the securing process comprises:

connecting the plurality of clusters to the base by at least an application of heat.

24. The method of claim 23, wherein the application of heat facilitates at least a partial melting of one or more of the plurality of clusters.

25. The method of claim 23, wherein the application of heat comprises heat fusing.

26. The method of claim 23, wherein the application of heat comprises heat sealing.

27. The method of claim 23, wherein the application of heat facilitates at least a partial melting of at least some of the artificial hairs at the region where the two or more artificial hairs of the first cluster cross the two or more artificial hairs of the second cluster.

28. The method of claim 21, wherein performing the securing process comprises: connecting the plurality of clusters to the base by at least an application of an adhesive.

29. The method of claim 21, wherein performing the securing process comprises: connecting the plurality of clusters to the base by at least an application of a string.

30. The method of claim 21, wherein performing the securing process comprises:

connecting the plurality of clusters to the base by at least an application of one or more fibers.

31. The method of claim 21, wherein the region where the two or more artificial hairs of the first cluster cross the two or more artificial hairs of the second cluster is located between the proximal ends and the distal ends of the two or more artificial hairs of both the first cluster and the second cluster.

32. The method of claim 31, wherein the proximal ends of each of the multiple artificial hairs of the plurality of clusters are unconnected to the base.

33. The method of claim 21, wherein the multiple artificial hairs comprise a synthetic material.

34. The method of claim 33, wherein the multiple artificial hairs comprise at least one of polybutylene terephthalate (PBT) or polyester.

35. The method of claim 21, wherein the multiple artificial hairs comprise a natural material.

36. The method of claim 35, wherein the multiple artificial hairs comprise one of silk, human hair, or animal hair.

37. The method of claim 21, wherein the base has a thickness between about 0.05 millimeters and about 0.15 millimeters.

38. The method of claim 21, wherein the plurality of lash extensions are designed to attach to natural lashes.

39. The method of claim 38, wherein the plurality of lash extension are designed to attach in an arrangement adjacent to one another at the natural lashes.

40. The method of claim 38, wherein the plurality of lash extensions are designed to attach to an underside of the natural lashes.

* * * * *